219-121 SR
3/17/87 XR 4,651,326

United States Patent [19]

Hubweber et al.

[11] Patent Number: 4,651,326

[45] Date of Patent: Mar. 17, 1987

[54] ELECTRIC FURNACE ARRANGEMENT

[75] Inventors: Gerhard Hubweber, Frankenmarkt; Maximilian Mayringer, Neufelden, both of Austria

[73] Assignee: Voest-Alpine Aktiengesellschaft, Linz, Austria

[21] Appl. No.: 873,511

[22] Filed: Jun. 12, 1986

[30] Foreign Application Priority Data

Jun. 17, 1985 [AT] Austria ..... 1792/85

[51] Int. Cl.[4] ..... H05H 1/26

[52] U.S. Cl. ..... 373/22; 219/121 PA

[58] Field of Search ..... 373/18–24, 373/94, 95, 98, 99, 100; 219/121 PA, 121 PC, 121 PM, 121 PV, 121 PX

[56] References Cited

U.S. PATENT DOCUMENTS 3,429,564 2/1969 Snow ..... 373/21 X
3,783,167 1/1974 Tylko ..... 373/23
3,894,573 7/1975 Paton et al. ..... 373/21 X
4,018,973 4/1977 Paton et al. ..... 373/21 X
4,326,842 4/1982 Adachi et al. ..... 219/121 PA
4,415,795 11/1983 Ross et al. ..... 219/121 PV

*Primary Examiner*—Roy N. Envall, Jr.
*Attorney, Agent, or Firm*—Hopgood, Calimafde, Kalil, Blaustein & Judlowe

[57] ABSTRACT

An electric furnace, in particular a plasma furnace, includes an electrode axially displaceable and pivotable in an electrode retaining device. In order to provide for a freedom of motion as large as possible to the electrode, thereby reliably preventing local overheatings of the material to be heated and melted, the electrode is mounted on the electrode retaining device by a spherical bearing so as to be universally movable. The electrode is axially displaceably guided in the bearing and is movable relative to the bearing by at least one adjustment device engaging at the bearing with one end and at the electrode with the other end. At least two adjustment devices, which are directed at an angle to each other, seen in the axial direction of the electrode, are each hinged to the electrode retaining device with one end and to the bearing with the other end.

8 Claims, 4 Drawing Figures

ELECTRIC FURNACE ARRANGEMENT

The invention relates to an electric furnace, in particular a plasma furnace, comprising an electrode axially displaceable and pivotable in an electrode retaining means, in particular a plasma burner.

A plasma furnace of this type is known from British Pat. No. 1,390,351. With that electric furnace, the electrode has an axis inclined with respect to the vertical line and is inserted in a cylindrical bushing rotatable relative to the furnace, thus moving the axis of the electrode upon turning of the cylindrical bushing along a conical surface. The piston rod of a pressure medium cylinder engages the upper external end of the electrode by the intermediate of a tension rod hinged to the electrode by means of universal joints, thus lifting and lowering the electrode with respect to the cylinder bushing.

This known electric furnace has the disadvantage that it calls for a relatively large structural height and a large free space above the furnace vessel. Furthermore, the electrode is movable only along a cone having a predetermined aperture angle that cannot be changed, so that the electrode mouth piece is movable only along a circle having a definite diameter when positioning the electrode at a determined height.

Since the introduction of heat into the material to be heated and melted is effected at those sites at which the electric arc impinges on the material, an undesired local overheating of the melted material may occur, if the electrode has not enough freedom of motion with respect to the material to be heated and melted.

The invention has as its object to provide an electric furnace of the initially defined kind, in which the electrode has a freedom of motion as large as possible and local overheatings of the material to be heated and melted are reliably prevented. By the electric furnace according to the invention, a heat introduction as uniform as possible over the major portion of the surface of the material is to be feasible. In addition, the electric furnace is to be compact, having a low structural height.

This object is achieved according to the invention in that the electrode is mounted on the electrode retaining means by a spherical bearing so as to be universally movable, wherein the electrode is axially displaceably guided in the bearing and is movable relative to the bearing by at least one adjustment means engaging at the bearing with one end and at the electrode with the other end, and wherein, furthermore, at least two adjustment means, which are directed at an angle to each other, seen in the axial direction of the electrode, are each hinged to the electrode retaining means with one end and to the bearing with the other end.

A preferred embodiment is characterized in that the spherical bearing is designed as a spherical joint whose sphere is designed to be elongated by a sleeve surrounding the electrode over part of its length in the axial direction of the electrode, at which sleeve there engage both the adjustment means for axially displacing the electrode and the adjustment means for pivoting the bearing.

Preferably, the electrode is guided in the lid of the furnace, i.e., in other words, the lid of the furnace functions as an electrode retaining means.

To compensate for the current path from the cathode to a bottom electrode of the electric furnace, which becomes longer with an increasing electrode excursion (and to avoid the resulting voltage drop in the bath), the bottom electrode suitably is arranged at the lowermost point of a trough-shaped concavity of the bottom, which trough-shaped concavity advantageously has a depth with respect to the remaining bottom, that is approximately equal to the maximum bath depth measured from the bottom.

In order to keep the current feed cable free from torsional strains, the bearing suitably is secured against rotation about the axis of the electrode on the electrode retaining means by a torsion blocking means, in particular by a holding means rigidly mounted to the bearing and movably supported on the electrode retaining means.

The invention will now be explained in more detail by way of two embodiments and with reference to the accompanying drawings, wherein.

Figure 1:
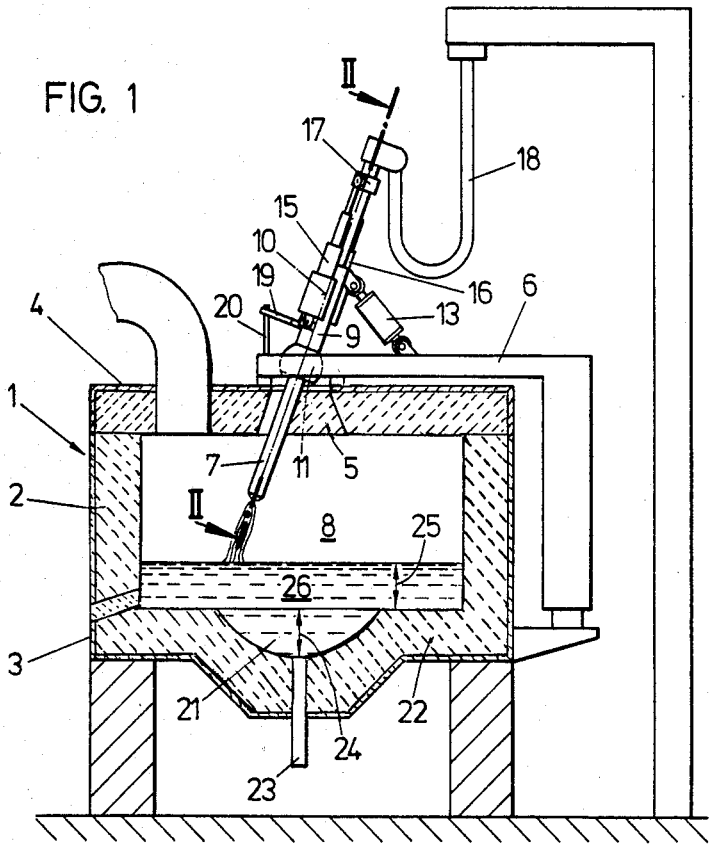
FIG. 1 is a section through a schematically illustrated plasma furnace.
Figure 3:
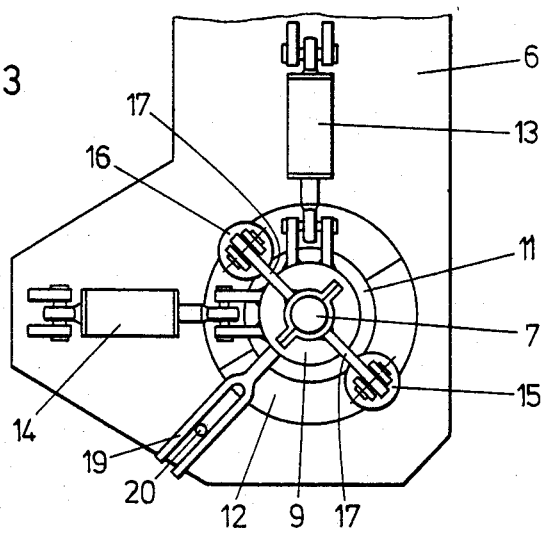
FIG. 3 is a view in the direction of the arrow III of FIG. 2.
Figure 2:
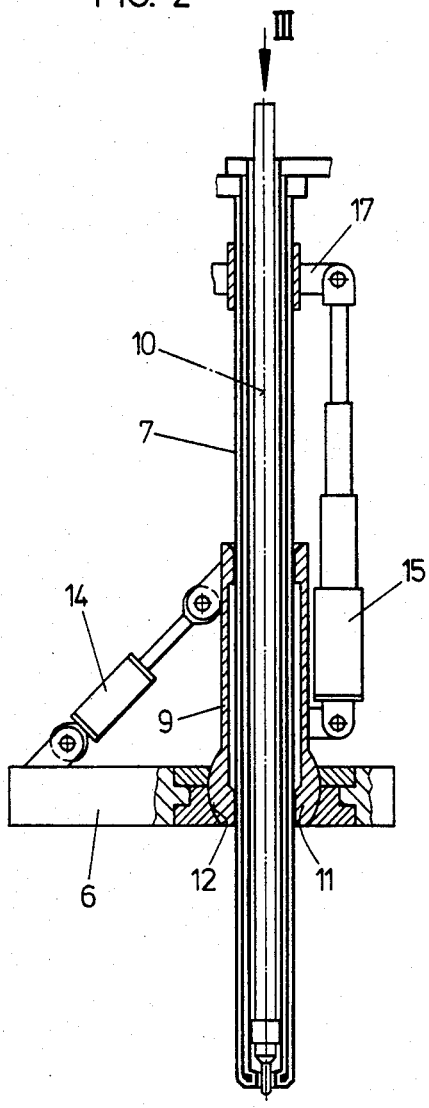
FIG. 2 is a section along line II—II of FIG. 1.

A plasma furnace 1 comprises a furnace vessel 3 provided with a refractory lining 2 and is covered by a lid 4. In the lid 4, an opening 5 is centrally provided, through which a water-cooled electrode 7, i.e., a plasma burner, which is mounted on an electrode retaining means 6 positioned closely above the lid 4, projects into the furnace interior 8.

The electrode 7 is guided in a guiding sleeve 9 to be movable in the direction of its axis 10. The guiding sleeve 9, on its lower end, comprises a spherical bearing part 11, which is universally pivotably mounted on the electrode retaining means 6 in a horizontally divisible spherical cup 12. Thereby, the electrode 7 may be inclined into any desired angular position with respect to the vertical line. Two adjustment means, which are designed as pressure medium cylinders 13, 14, preferably enclosing an angle of 90° in the ground plan, serve to pivot the electrode 7, which pressure medium cylinders 13, 14 are hinged to the electrode retaining means 6 with one end and, at a vertical distance therefrom, to the upper end of the guiding sleeve 9 with their other end.

Two pressure medium cylinders 15, 16 serve for the axial displacement of the electrode 7, which pressure medium cylinders 15, 16 are each hinged to the guiding sleeve 9 and to the electrode 7 via brackets 17 and are aligned with their axes parallel to the electrode 7.

In order to prevent the rotation of the electrode 7 and, thus, a torsional strain on the current feed cable 18 and on the coolant ducts, a fork-shaped torsion blocking means 19 extending radially outwardly is arranged on the guiding sleeve 9, into which a pin 20 fixed to the electrode retaining means engages.

The furnace vessel 3 has a bottom 22 provided with a central trough-shaped concavity 21, a bottom electrode (anode) 23 being arranged on the lowermost site of the concavity 21. The spherical concavity 21, as compared to the remaining bottom 22 that is approximately horizontal, has a depth 24 approximately equalling the maximum bath depth 25 of the bath 26, measured from the approximately horizontal bottom 22. By arranging the bottom electrode 23 in the central concavity 21, the current path, which becomes longer with the excursion of the electrode 7 increasing, is elongated by a slighter extent than with a bottom 22 that has no concavity 21, whereby the voltage drop in the bath 26 resulting from the elongated current path may be kept lower than with a bottom having no sunk in anode.

In order to exchange the electrodes 7, the pressure medium cylinders 15, 16 or the brackets 17 are detached from the electrode 7; subsequently, the electrode 7 can be extracted from the guiding sleeve 9.

Figure 4:
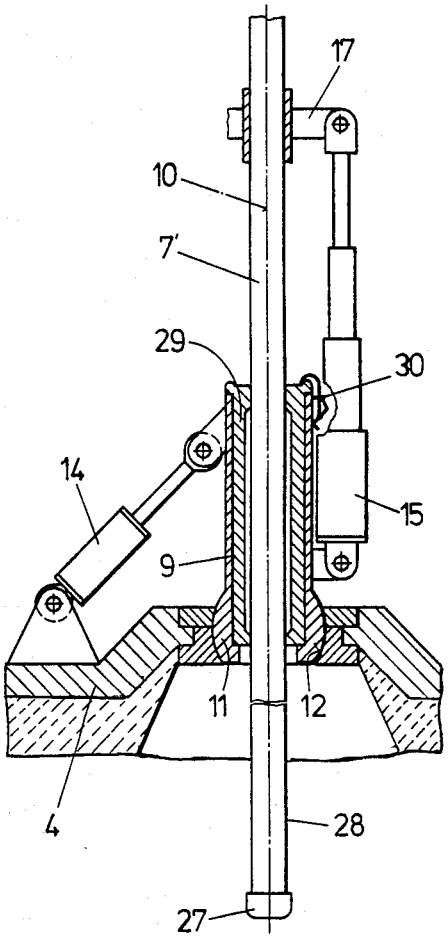
FIG. 4 shows a further embodiment in an illustration analogous to FIG. 2.

According to FIG. 4, the guiding sleeve 9, with its spherical bearing part 11, is arranged directly on the lid 4 of the plasma furnace 1. Moreover, the electrode 7' according to FIG. 4 comprises a mouth piece 27 having a diameter that is larger than the shaft 28 of the electrode 7'. In order to be able to replace the electrode 7' in a simple way, a sliding body 29 is inserted in the guiding sleeve 9 and is fixed to the guiding sleeve 9 by a quick-clamping means 30. To exchange the electrode 7', it suffices to detach the quick-clamping means 30 and to pull the electrode 7' out of the guiding sleeve 9 commonly with the sliding body 29.

The invention is not limited to the embodiments illustrated, but may be modified in various aspects. Thus, any other adjustment means, such as, e.g., adjusting spindles, may be used instead of the pressure medium cylinders 13, 14 and/or 15, 16. Moreover, it is possible to provide several (for instance, three) electrodes, which are independently pivotable. The invention is suited not only for plasma burners, but even for conventional electrodes.

What we claim is:

1. An electric furnace arrangement including an electrode retaining means and an electrode axially displaceable and pivotable in said electrode retaining means, which arrangement comprises a spherical bearing to mount said electrode on said electrode retaining means so as to be universally movable, said electrode being axially displaceably guided in said spherical bearing, at least one first adjustment means having a first end engaging at said spherical bearing and a second end engaging at said electrode and being displaceable relative to said spherical bearing, and at least two further adjustment means directed at an angle to each other, seen in the axial direction of said electrode, and each having a first end hinged to said electrode holding means and a second end hinged to said bearing.

2. An electric furnace arrangement as set forth in claim 1 which is designed as a plasma furnace and wherein said electrode is a plasma burner.

3. An electric furnace arrangement as set forth in claim 1, wherein said spherical bearing is designed as a spherical joint including a sphere elongated by a sleeve in the axial direction of said electrode, said sleeve surrounding said electrode over part of its length and being in engagement with said first adjustment means adapted to axially displace said electrode and with said further adjustment means adapted to pivot said bearing.

4. An electric furnace arrangement as set forth in claim 1, further comprising a furnace lid through which said electrode is guided.

5. An electric furnace arrangement as set forth in claim 1, comprising a bottom electrode and a furnace bottom provided with a trough-shaped bottom concavity to receive said bottom electrode in its lowermost point.

6. An electric furnace arrangement as set forth in claim 5 and filled with a bath defining a bath depth, wherein said trough-shaped concavity has a concavity depth, with respect to the remaining furnace bottom, approximately equalling the maximum bath depth measured from said furnace bottom.

7. An electric furnace arrangement as set forth in claim 1, further comprising a torsion blocking means to secure said bearing on said electrode retaining means against rotation about the axis of said electrode.

8. An electric furnace arrangement as set forth in claim 7, wherein said torsion blocking means is formed by a holding means rigidly mounted to said spherical bearing and movably supported on said electrode retaining means.

* * * * *